US009468346B1

(12) United States Patent
Rzepka

(10) Patent No.: US 9,468,346 B1
(45) Date of Patent: Oct. 18, 2016

(54) VACUUM CLEANER NOZZLE WITH A ROLLER ATTACHMENT

(71) Applicant: Gary Rzepka, South Bend, IN (US)

(72) Inventor: Gary Rzepka, South Bend, IN (US)

( * ) Notice: Subject to any disclaimer, the term of this patent is extended or adjusted under 35 U.S.C. 154(b) by 0 days.

(21) Appl. No.: 14/851,277

(22) Filed: Sep. 11, 2015

(51) Int. Cl.
*A47L 9/02* (2006.01)
*A47L 5/34* (2006.01)

(52) U.S. Cl.
CPC ... *A47L 9/02* (2013.01); *A47L 5/34* (2013.01)

(58) Field of Classification Search
CPC ..... A47L 5/34; A47L 9/02
USPC ..... 15/354, 359, 360, 362, 415.1
IPC ..... A47L 9/02
See application file for complete search history.

(56) References Cited

U.S. PATENT DOCUMENTS

| | | | |
|---|---|---|---|
| 2,278,382 | A | 3/1942 | Ross |
| 4,809,395 | A | 3/1989 | Fleischhauer |
| 5,481,781 | A | 1/1996 | Weber |
| 6,979,373 | B1 | 12/2005 | Rogers |
| 8,499,772 | B2 | 8/2013 | Schumacher |

*Primary Examiner* — David Redding
(74) *Attorney, Agent, or Firm* — Crossley & Stevenson Intellectual Property Law

(57) ABSTRACT

A vacuum cleaner nozzle with a roller attachment including a vacuum cleaner nozzle having a base, a circular outlet opening, and a substantially rectangular inlet opening. A right side support of a pair of side supports is attached to an interior surface of a right side of the base within the inlet opening, and a left side support of the pair of side supports is attached to an interior surface of a left side of the base within the inlet opening. An axle is continuously disposed between the right side support and the left side support. A roller is continuously disposed around the axle. The right collar of a pair of collars is attached to a right surface of the roller, and a left collar of the pair of collars is attached to a left surface of the roller.

5 Claims, 3 Drawing Sheets

VACUUM CLEANER NOZZLE WITH A ROLLER ATTACHMENT

BACKGROUND OF THE INVENTION

Various types of vacuum cleaner nozzles are known in the prior art. However, what has been needed is a vacuum cleaner nozzle with a roller attachment including a vacuum cleaner nozzle having a base, a circular outlet opening, and a substantially rectangular inlet opening. What has been further needed is a right side support of a pair of side supports attached to an interior surface of a right side of the base within the inlet opening, a left side support of the pair of side supports attached to an interior surface of a left side of the base within the inlet opening, an axle continuously disposed between the right side support and the left side support, and a roller continuously disposed around the axle having a continuous outer surface that is disposed outside of the inlet opening underneath a bottom surface of the base. Lastly, what has been needed is a right collar of a pair of collars attached to a right surface of the roller, and a left collar of the pair of collars attached to a left surface of the roller. The roller medially disposed on the axle within the inlet opening of the base ensures that the bottom surface of the base stays off the floor while the vacuum cleaner nozzle moves across the floor surface. This structure is an improvement over existing vacuum cleaner nozzles since the raised bottom surface and the roller is structured to extend the life of the vacuum cleaner nozzle by allowing a greater degree of airflow underneath the base and assisting in the movement of the base across the floor.

FIELD OF THE INVENTION

The present invention relates to vacuum cleaner nozzles, and more particularly, to a vacuum cleaner nozzle with a roller attachment.

SUMMARY OF THE INVENTION

The general purpose of the present vacuum cleaner nozzle with a roller attachment, described subsequently in greater detail, is to provide a vacuum cleaner nozzle which has many novel features that result in a vacuum cleaner nozzle with a roller attachment which is not anticipated, rendered obvious, suggested, or even implied by prior art, either alone or in combination thereof.

To accomplish this, the present vacuum cleaner nozzle with a roller attachment includes a vacuum cleaner nozzle having a base, a circular outlet opening disposed on a top surface of the base, and a substantially rectangular inlet opening disposed within a bottom surface of the base. The base has a right side, a left side, a front side, and a back side. Each of the right side, the left side, the front side, and the back side has an interior surface and an exterior surface. The vacuum cleaner nozzle further includes a pair of side supports. The pair of side supports includes a right side support and a left side support. Each of the right side support and the left side support has a bottom side. The right side support is attached to the interior surface of the right side of the base within the inlet opening, and the left side support is attached to the interior surface of the left side of the base within the inlet opening. The bottom side of each of the right side support and the left side support is disposed outside of the inlet opening underneath the bottom surface of the base.

Each of the pair of side supports is optionally rectangular in order to better fit within the inlet opening on the vacuum cleaner nozzle.

An axle is continuously disposed between the right side support and the left side support. The axle has a right edge and a left edge. The right edge of the axle is rotatably attached to the right side support, and the left edge of the axle is rotatably attached to the left side support. A roller is continuously disposed around the axle. The roller is medially disposed between the right edge of the axle and the left edge of the axle. The roller and each of the pair of side supports is optionally nylon. A pair of collars is continuously disposed around the axle. The pair of collars includes a right collar and a left collar. The right collar is attached to a right surface of the roller, and the left collar is attached to a left surface of the roller. A continuous outer surface of the roller is disposed outside of the inlet opening underneath the bottom surface of the base. The outer surface of the roller is collinearly disposed with the bottom side of each of the right side support and the left side support. The pair of side supports provides additional supportive assistance to the roller, and the pair of collars maintains the placement of the roller on the axle. The roller is configured to move the vacuum cleaner nozzle across a floor surface while the bottom surface of the base remains raised above the floor surface.

Thus has been broadly outlined the more important features of the present vacuum cleaner nozzle with a roller attachment so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
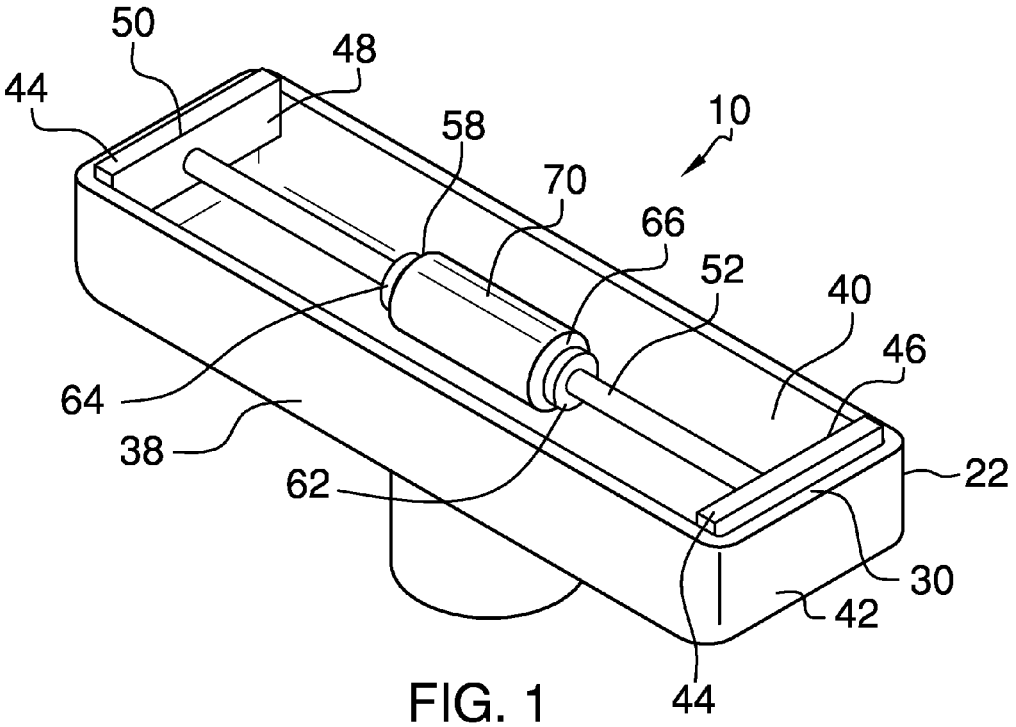
FIG. 1 is a bottom isometric view.
Figure 2:
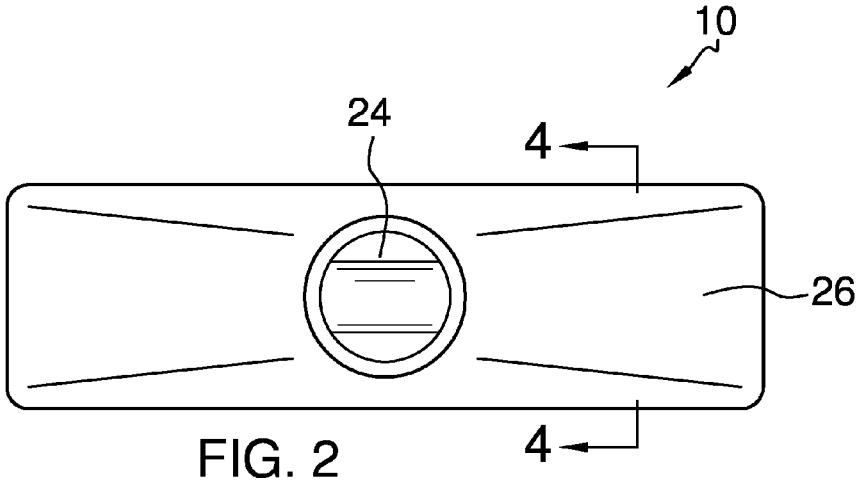
FIG. 2 is a top plan view.
Figure 3:
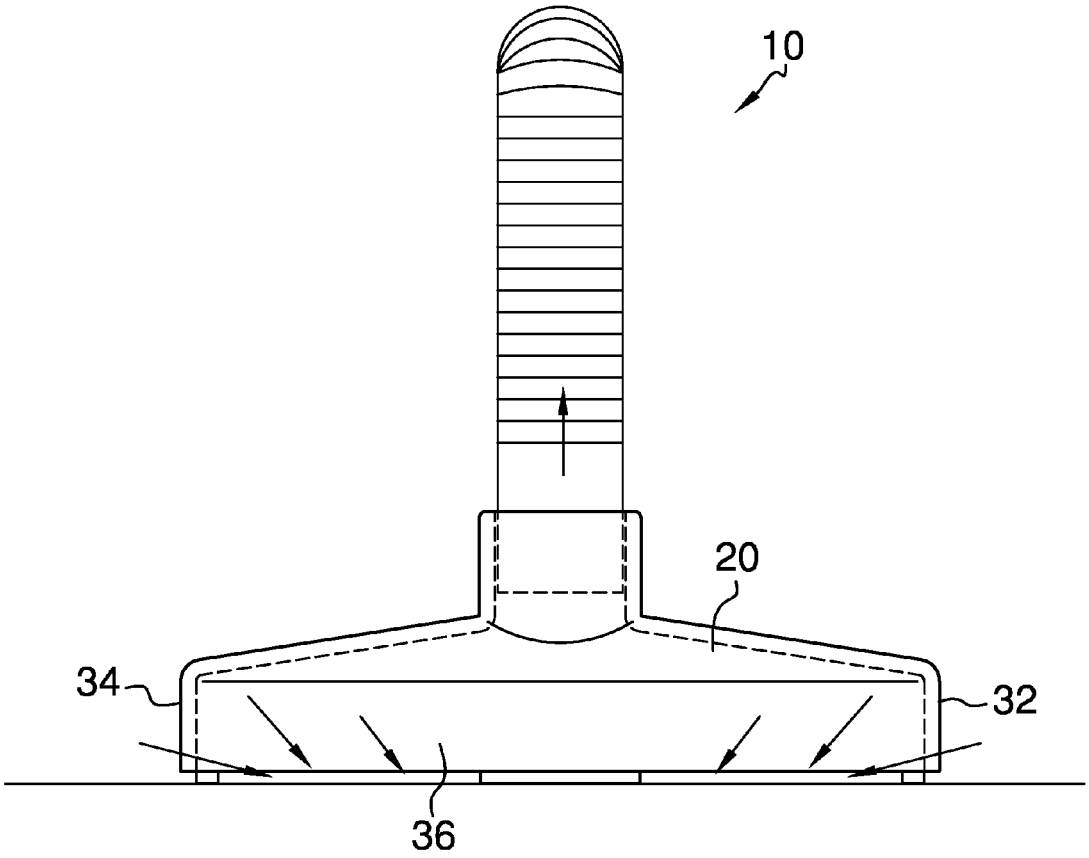
FIG. 3 is a front elevation view.
Figure 4:
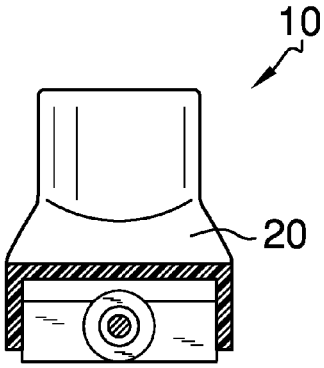
FIG. 4 is a cross-sectional view taken along line 4-4 of FIG. 2.
Figure 5:
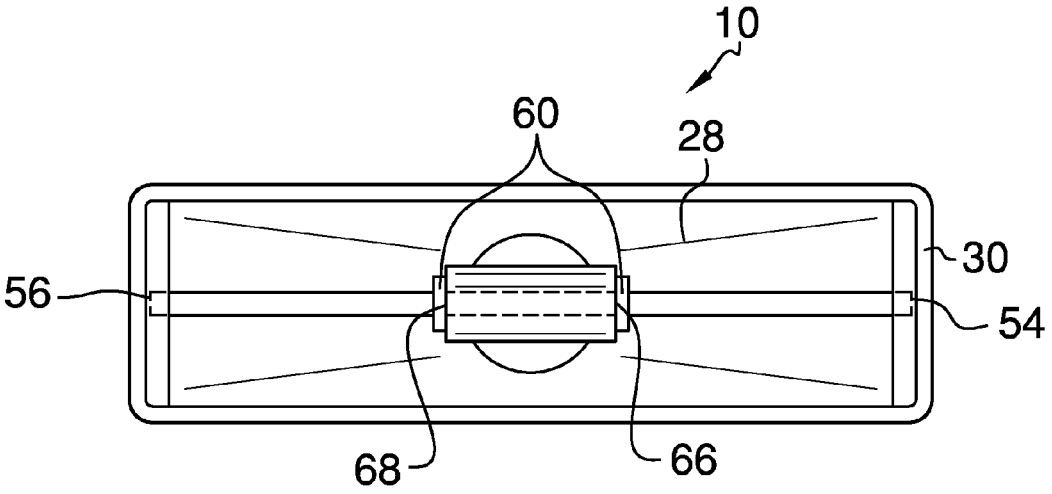
FIG. 5 is a bottom plan view.

With reference now to the drawings, and in particular FIGS. 1 through 5 thereof, an example of the instant vacuum cleaner nozzle with a roller attachment employing the principles and concepts of the present vacuum cleaner nozzle with a roller attachment and generally designated by the reference number 10 will be described.

Referring to FIGS. 1 through 5 the present vacuum cleaner nozzle with a roller attachment 10 is illustrated. The vacuum cleaner nozzle with a roller attachment 10 includes a vacuum cleaner nozzle 20 having a base 22, a circular outlet opening 24 disposed on a top surface 26 of the base 22, and a substantially rectangular inlet opening 28 disposed within a bottom surface 30 of the base 22. The base 22 has a right side 32, a left side 34, a front side 36, and a back side 38. Each of the right side 32, the left side 34, the front side 36, and the back side 38 has an interior surface 40 and an exterior surface 42. The vacuum cleaner nozzle 20 further includes a pair of side supports 44. The pair of side supports 44 includes a right side support 46 and a left side support 48. Each of the right side support 46 and the left side support 48 has a bottom side 50. The right side support 46 is attached to the interior surface 40 of the right side 32 of the base 22 within the inlet opening 28, and the left side support 48 is attached to the interior surface 40 of the left side 34 of the base 22 within the inlet opening 28. The bottom side 50 of each of the right side support 46 and the left side support 48 is disposed outside of the inlet opening 28 underneath the bottom surface 30 of the base 22. Each of the pair of side supports 44 is optionally rectangular.

An axle 52 is continuously disposed between the right side support 46 and the left side support 48. The axle 52 has a right edge 54 and a left edge 56. The right edge 54 of the axle 52 is rotatably attached to the right side support 46, and the left edge 56 of the axle 52 is rotatably attached to the left side support 48. A roller 58 is continuously disposed around the axle 52. The roller 58 is medially disposed between the right edge 54 of the axle 52 and the left edge 56 of the axle 52. A pair of collars 60 is continuously disposed around the axle 52. The pair of collars 60 includes a right collar 62 and a left collar 64. The right collar 62 is attached to a right surface 66 of the roller 58, and the left collar 64 is attached to a left surface 68 of the roller 58. A continuous outer surface 70 of the roller 58 is disposed outside of the inlet opening 28 underneath the bottom surface 30 of the base 22. The outer surface 70 of the roller 58 is collinearly disposed with the bottom side 50 of each of the right side support 46 and the left side support 48.

What is claimed is:

1. A vacuum cleaner nozzle with a roller attachment comprising:

a vacuum cleaner nozzle having a base, a circular outlet opening disposed on a top surface of the base, and a substantially rectangular inlet opening disposed within a bottom surface of the base, the base having a right side, a left side, a front side, and a back side, each of the right side, the left side, the front side, and the back side having an interior surface and an exterior surface;

a pair of side supports comprising a right side support and a left side support, each of the right side support and the left side support having a bottom side, wherein the right side support is attached to the interior surface of the base right side within the inlet opening, and the left side support is attached to the interior surface of the base left side within the inlet opening, wherein the bottom side of each of the right side support and the left side support is disposed outside of the inlet opening underneath the base bottom surface;

an axle continuously disposed between the right side support and the left side support the axle medially disposed between the front side and the back side, the axle having a right edge and a left edge, wherein the right edge is rotatably attached to the right side support, and the left edge is rotatably attached to the left side support;

a roller continuously disposed around the axle, wherein the roller is medially disposed between the axle right edge and the axle left edge; and a pair of collars continuously disposed around the axle, the pair of collars comprising a right collar and a left collar, wherein the right collar is attached to a right surface of the roller, and the left collar is attached to a left surface of the roller;

wherein a continuous outer surface of the roller is disposed outside of the inlet opening underneath the base bottom surface;

wherein the roller outer surface is collinearly disposed with the bottom side of each of the right side support and the left side support;

wherein the roller is configured to move the vacuum cleaner nozzle across a floor surface while the bottom surface of the base remains raised above the floor surface.

2. The vacuum cleaner nozzle with a roller attachment of claim 1 wherein each of the pair of side supports is rectangular.

3. The vacuum cleaner nozzle with a roller attachment of claim 1 wherein the roller is nylon.

4. The vacuum cleaner nozzle with a roller attachment of claim 2 wherein each of the pair of side supports is nylon.

5. A vacuum cleaner nozzle with a roller attachment comprising:

a vacuum cleaner nozzle having a base, a circular outlet opening disposed on a top surface of the base, and a substantially rectangular inlet opening disposed within a bottom surface of the base, the base having a right side, a left side, a front side, and a back side, each of the right side, the left side, the front side, and the back side having an interior surface and an exterior surface;

a pair of rectangular side supports comprising a right side support and a left side support, each of the right side support and the left side support having a bottom side, wherein the right side support is attached to the interior surface of the base right side within the inlet opening, and the left side support is attached to the interior surface of the base left side within the inlet opening, wherein the bottom side of each of the right side support and the left side support is disposed outside of the inlet opening underneath the base bottom surface;

wherein each of the pair of side supports is nylon;

an axle continuously disposed between the right side support and the left side support, the axle having a right edge and a left edge, wherein the right edge is rotatably attached to the right side support, and the left edge is rotatably attached to the left side support the axle medially disposed between the front side and the back side;

a roller continuously disposed around the axle, wherein the roller is medially disposed between the axle right edge and the axle left edge;

wherein the roller is nylon; and a pair of collars continuously disposed around the axle, the pair of collars comprising a right collar and a left collar, wherein the right collar is attached to a right surface of the roller, and the left collar is attached to a left surface of the roller;

wherein an outer surface of the roller is disposed outside of the inlet opening underneath the base bottom surface;

wherein the roller outer surface is collinearly disposed with the bottom side of each of the right side support and the left side support;

wherein the roller is configured to move the vacuum cleaner nozzle across a floor surface while the bottom surface of the base remains raised above the floor surface.

* * * * *